United States Patent [19]

Wilkens

[11] 4,395,888

[45] Aug. 2, 1983

[54] CONTROLLED THREAD GUIDES FOR A WEFT THREAD MAGAZINE

[75] Inventor: Christian Wilkens, Heusenstamm, Fed. Rep. of Germany

[73] Assignee: Karl Mayer Textilmaschinenfabrik GmbH, Obertshausen, Fed. Rep. of Germany

[21] Appl. No.: 312,744

[22] Filed: Oct. 19, 1981

[30] Foreign Application Priority Data

Oct. 25, 1980 [DE] Fed. Rep. of Germany ..... 3040393

[51] Int. Cl.[3] ..... D05C 15/00

[52] U.S. Cl. ..... 66/84 A

[58] Field of Search ..... 66/85 A, 84 A, 84 R, 66/85 R; 28/100; 156/440

[56] References Cited

U.S. PATENT DOCUMENTS 3,707,083 12/1972 Svoboda et al. ..... 66/85 A
3,756,043 9/1973 Vemter ..... 66/85 R
3,771,330 11/1973 Carman ..... 66/84 A

FOREIGN PATENT DOCUMENTS 45-33874 10/1970 Japan ..... 66/85 A

*Primary Examiner*—Ronald Feldbaum
*Attorney, Agent, or Firm*—Omri M. Behr

[57] ABSTRACT

A weft thread magazine operates in a warp knitting machine having a needle bed. This magazine includes a pair of endless transfer chains, each having a plurality of holders for retaining weft threads in parallel and for delivering them to the needle bed. Also included is a thread laying arrangement operable to transversely reciprocate between the transfer chains and to transport weft threads from one chain to the other. The arrangement also includes a carriage having a plurality of thread guides for transferring weft threads around the holders as the thread laying arrangement reverses direction. These thread guides can reciprocate between an operative and inoperative position. In the inoperative position, the thread guides are precluded from transferring thread to the holders. The magazine also includes a control device for moving the thread guides between the operative and inoperative position.

12 Claims, 14 Drawing Figures

12
22
28
24
69
76
54
74
72
52
42
86'
96'
78'
84'
100
80'
82'
88'
B
A
X1
X2
X3
X4
X5
63
61
62
142
140
112
68
44
110
146
144
96
80
84
82
78
86
88
132
136
134
130
50
58
64
60
71
70
67
56

CONTROLLED THREAD GUIDES FOR A WEFT THREAD MAGAZINE

BACKGROUND OF THE INVENTION

1. Field of the Invention

The present invention relates to weft thread magazines for laying of weft threads in a warp knitting machine having a pair of parallel, separated, transfer chains and having a carriage reciprocatable between said chains. The carriage comprises at least one group of thread guides which can be operated to transfer the threads to holding devices on the transfer chains.

2. Discussion of the Relevant Art

In a known weft thread magazine of this type, as disclosed in U.S. Pat. No. 3,665,732, a group of thread guides which in practice comprise 12, 18 or 24 single thread guides, are attached to a carriage moving to and fro in a crosswise direction. When the thread guides are connected to the carriage, the weft threads are laid in a diagonal direction whereby the angle of the diagonal is established by the relative motion of the thread guide group. When the thread guide group is firmly attached to a sled which is movable to and fro in the longitudinal direction on the carriage, it is possible to lay the weft threads parallel to each other. It is further possible to provide two or more weft thread groups on the carriage which can lay weft threads sequentially around the same holding means of the transfer chains whereby one group of thread guides lays parallel weft threads and the other thread guides lay diagonal weft threads.

In all of these cases, the patterning possibilities are rather limited, since the pattern repeat is predetermined by the number of thread guides in a group.

A further weft thread magazine for warp knitting machines is known (DEOS No. 2401050). In this arrangement, one out of a group of different weft threads can be fed to a corresponding one of the thread guides. To this end, several sets of weft thread spools are provided for each of the thread guides and a weft thread selector and thread splicer is used to vary the weft threads. In this way, the type of material or the color of the weft thread can be altered. This expansion of patterning variety, however, brings about a lowering of the working speed. Furthermore, care must be taken that the knots are kept outside of the weft inlay segment. Furthermore, the utilization of weft threads having different properties with respect to thread volume, elasticity and the like is very difficult to implement. Additionally, substantial tension peaks occur in the threads when the knots run through the thread guide.

Accordingly, there is a need for a weft thread magazine of the known type but having an expanded possibility of new patterns and, in particular, the possibility of substantially increased pattern types.

SUMMARY OF THE INVENTION

A weft thread magazine according to the principles of the present invention is employed in a warp knitting machine having a needle bed. This magazine includes a pair of endless transfer means, each having holding means for retaining weft threads in parallel and for delivering them to said needle bed. Also included is a thread laying arrangement that can transversely reciprocate between the pair of transfer means and transport weft threads from one of the pair of transfer means to the other. The arrangement includes carriage means having a plurality of thread guides for transferring weft threads around the holding means as the thread laying arrangement reverses direction. These thread guides are reciprocatable between an operative and inoperative position. In the inoperative position, the thread guides are precluded from transferring thread to the holding means. The magazine also includes a control means for moving the thread guides between the operative and inoperative position.

By employing the foregoing apparatus, a thread guide group can be moved from an operative to an inoperative position so that, at the turning point, no transfer of the weft thread to the holding means occurs. Thus, it is possible to provide at will that the weft threads are not transferred to the holding means of the transfer chains. When the transfer chains and the carriage continue to move, this has the desired effect that a group of weft threads are either laid or not laid, that the weft threads can be laid with different diagonal angles, or that the weft threads can be laid, by choice, parallel or diagonally. This gives rise to a substantial rise in the patterning possibilities. In the preferred embodiment, this patterning is regulated by a relatively simple control means.

In a further embodiment, at least two thread guide groups are utilized which, by means of a steering arrangement, can be selectively brought into the operative or inoperative position. Thus, in addition to the previously described patterning modes, two or more thread guide groups can be layed alternatively or at the same time in a desired combination. This permits a heretofore unknown patterning repeat.

BRIEF DESCRIPTION OF THE DRAWINGS

In order that the invention may be more fully understood, it will now be described, by way of example, with reference of the accompanying drawings in which.

DESCRIPTION OF THE PREFERRED EMBODIMENTS

Figure 1:
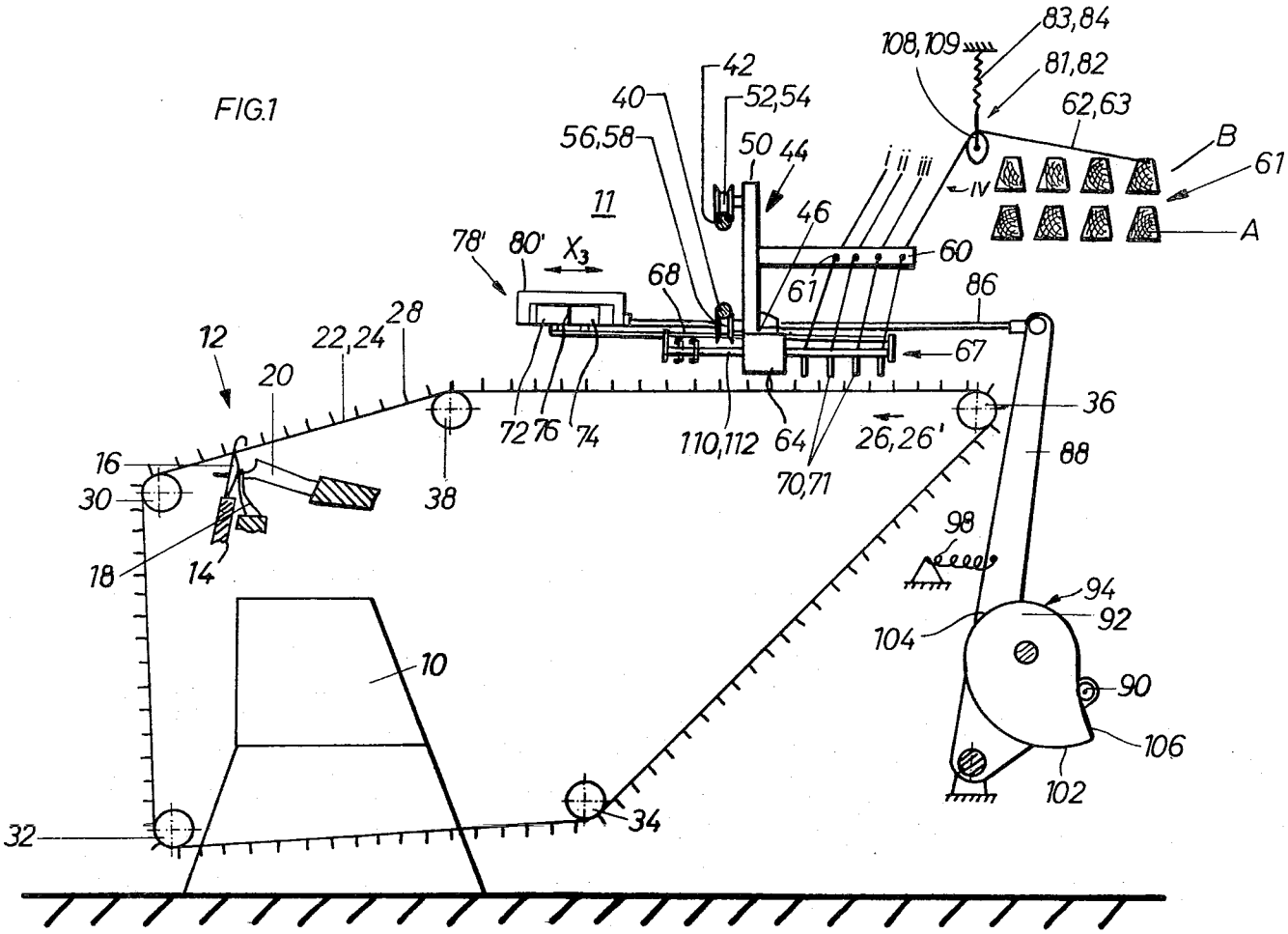
FIG. 1 is a schematic side view of a weft thread magazine in a warp knitting machine according to the teachings of the present invention.
Figures 2, 4, 5:
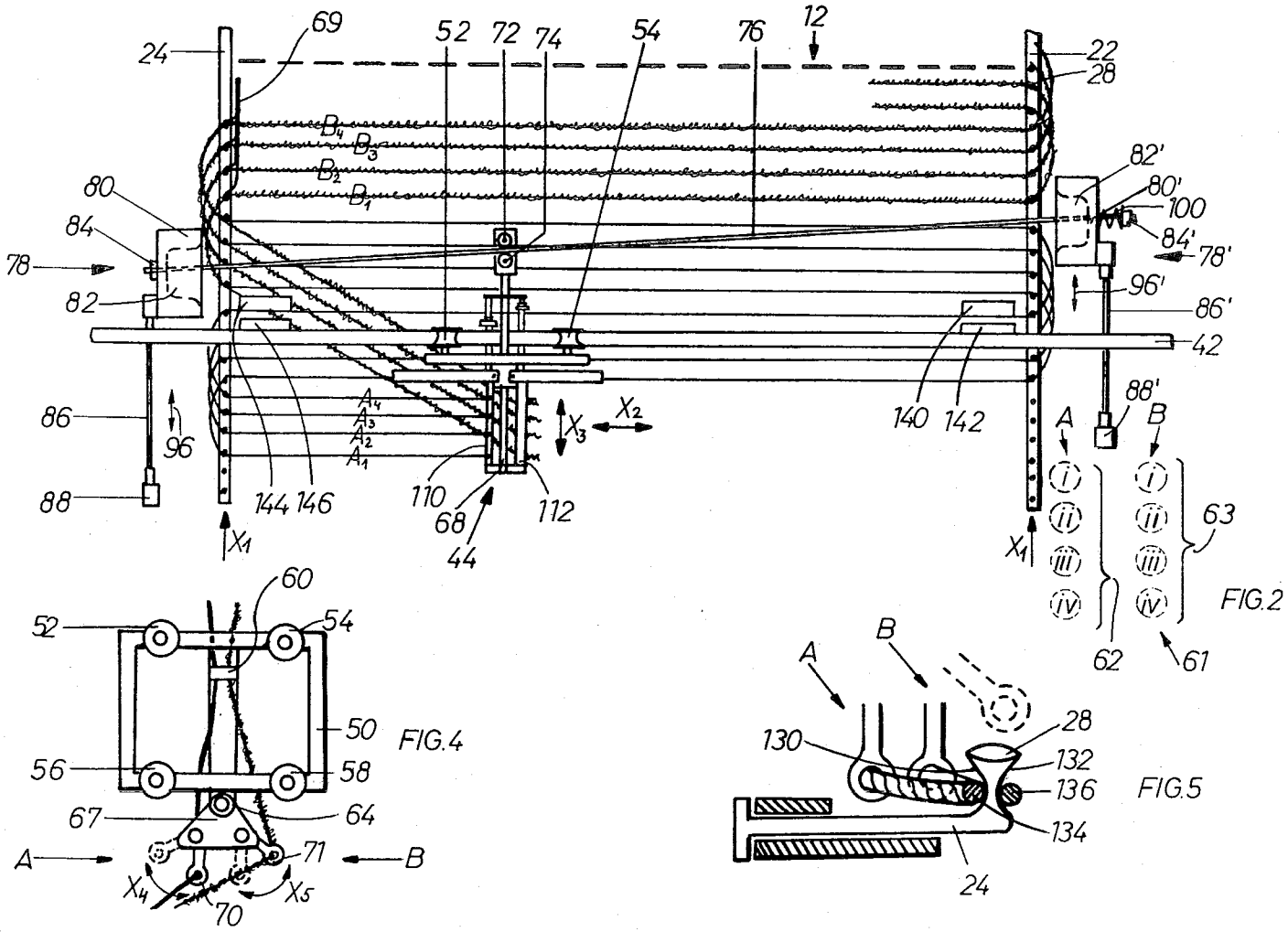
FIG. 2 is a schematic plan view of the weft thread magazine and warp knitting machine of FIG. 1.
FIG. 4 is an end view of the carriage of FIG. 3.
FIG. 5 is a detailed view of an individual holding device of FIG. 1.

Referring now to the Figures, and in particular to FIGS. 1 and 2, they disclose a warp knitting machine 10 and weft thread magazine 11 of the instant invention. The warp knitting machine 10 includes a needle bed 12 which has a needle bar 14 having a plurality of hook needles 16 disposed thereon in a conventional manner. The needles 16 cooperate with a slider mechanism 18 and a knockover sinker 20 all of which are a conventional design. On each end of the needle bed 12 there is provided a pair of endless transfer chain means 22 and 24 which move in a longitudinal direction as shown by arrows 26 and 26'. The transfer chains are provided with a plurality of holding means 28 equally spaced and fixed to the transfer chains 22 and 24 in a conventional manner. The holding means are holders, preferably, having a pawn-like shape (an enlarged top with a narrowed neck upon a thickened base) and serve to hold the weft thread once it is wrapped therearound.

The transfer chains are endless and are led over a plurality of rollers 30, 32, 34, 36 and 38 of which at least one is connected to a source of driving power, not shown. In the transverse direction (perpendicular to both of the transfer chains) a pair of support rails 40 and 42 are disposed one above the other. A carriage 44 is driven forward and backward in a conventional manner, by means of a chain 46, belt or the like, as shown by arrow X2 in FIG. 2.

A thread laying arrangement employs carriage 44 which includes a frame 50 (FIGS. 1 and 2) and a pair of rollers or wheels 52 and 54 journaled in the upper portion of frame 50, in a conventional manner, and a pair of rollers or wheels 56 and 58 as journaled on the lower portion of the frame in the same manner. The rollers 52 and 54 are adapted to ride on the support rail 42 and the rollers 56 and 58 are adapted to ride on the support rail 40, permitting the carriage 44 to move freely thereon in a transverse direction. The carriage 44 is also provided with upper thread guide 60 (FIG. 1 only) which is provided with a plurality of apertures 61 therein through which the weft threads 62 and 63i, ii, iii, and iv are threaded. Preferably, the lower portion of the carriage frame 50 is provided with axial bearings shown herein as a bushings 64 having apertures therein which are adapted to slidably receive carrier 67 (FIGS. 1 and 2). One end of carrier 67 is provided with two sets of thread guides 70, 71 disposed thereon, for two groups of thread A and B. Carrier 67 includes an upper guide rod 68 which is also slidably mounted in bushings 64. The end of rod 68 nearest needle bed 12 is provided with a pair of rollers 72 and 74 journaled thereon. The rollers 72 and 74 are located on both sides of a flexible guide band 76 preferably made of steel. The carrier 67 and its guide rod 68 are permitted to freely move within the apertures of bushings 64 and this movement is obviously controlled by the position of rollers 72 and 74.

One end of flexible guide band 76 is preferably rigidly connected to a steering apparatus 78 which is provided with a housing 80 having an opening 82 therein adapted to receive rollers 72 and 74 therein, as well as retain band 76 by means of a nut 84 provided therefor. The steering apparatus 78 has its housing 80 coupled by means of a rod 86 and a lever 88 articulated therewith. The lever 88 is provided with a contact roller 90 journaled thereon which continually cooperates with a driven cam 92 having a curved surface 94 which cooperates with roller 90 thereby moving lever 88 and rod 86 in the direction of arrow 96 which is in the longitudinal direction. A spring 98 maintains tension on lever 88 so that contact roller 90 faithfully follows the surface 94 of cam 92.

On the opposite end of the needle bed, proximate transfer chain 22 a second steering apparatus 78' is provided. Steering apparatus 78' includes a housing 80' which is provided with an aperture 82' and is driven in the direction of arrow 96' by rod 86', lever 88' and a contact roller and cam arrangement, not shown, similar to the driving arrangement shown with regard to the steering apparatus 78. The band 76 is retained in the housing 80' by means of nut 84' and is also provided with a spring device 100 disposed between the nut and rear surface of the housing so that by tightening or loosening nut 84, the tension of the flexible guide band 76 may be adjusted. Next to the transfer chain 22, there is provided a creel 61 comprising two sets of weft thread spools, A and B, oriented on top of each other. From each of the said spool sets, weft threads 62 and 63 are each led over thread accumulators 81, 82 comprising springs 83, 84, axially supporting controlled rolls 108, 109.

From accumulators 81, 82, threads 62 and 63 are fed to upper thread guides 60, to thread guides 70, 71. In FIG. 2, upper thread guides 60 were deleted for clarity. In the drawings, only a few threads are shown for each group. It should be recognized that, in the working machine, it is contemplated to use 12, 18 or even 24 threads per group. Weft threads 62 will hereinafter be designated as threads A1 through A4 and the weft thread 63 of group B will be designated as B1 through B4.

While this specification discusses mainly the provision of two thread groups, A and B, three are contemplated (see FIG. 11), and the principles hereof should not be considered as thus numerically limited.

Figure 3:
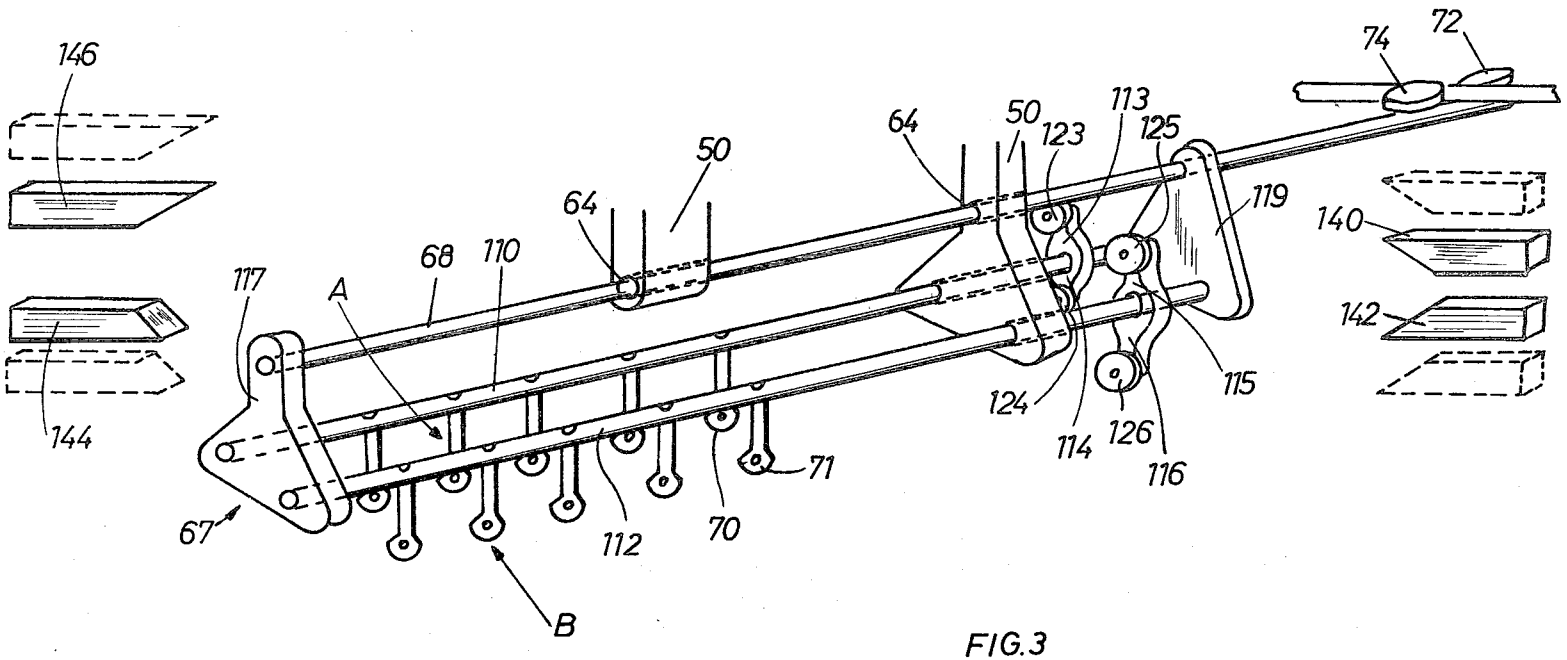
FIG. 3 is a detailed perspective representation of the two thread guide groups on the carriage of FIG. 1.
Figure 14:
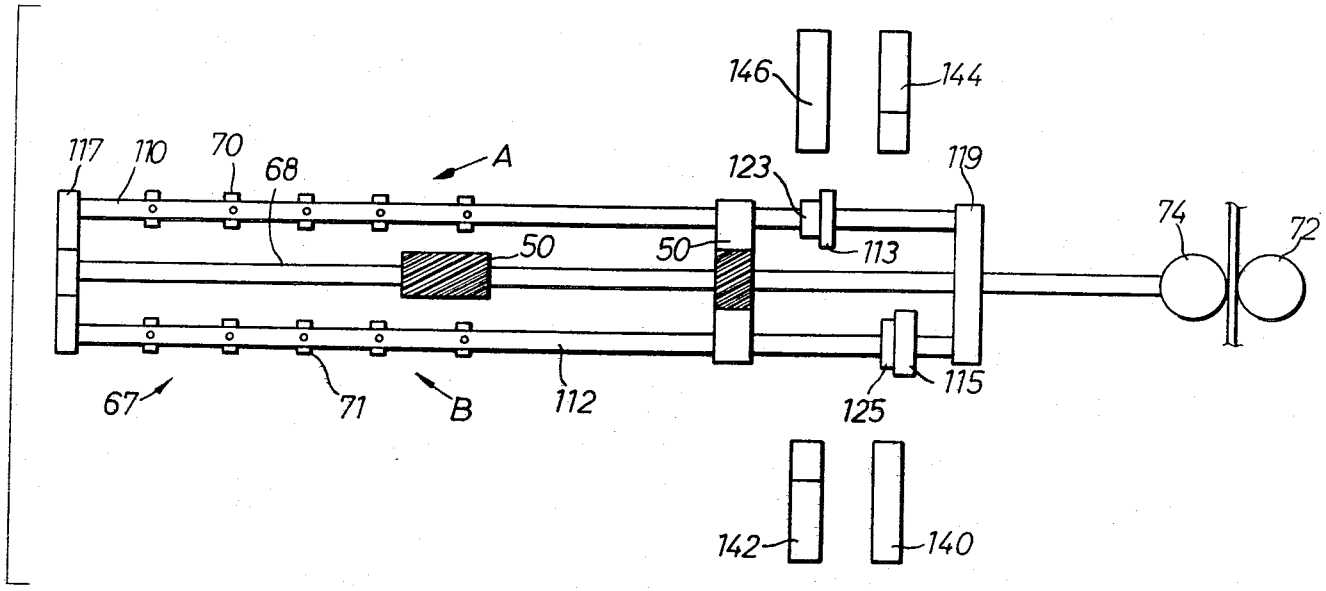
FIG. 14 is a plan view of the arrangement of FIG. 3.

The specific structure of carrier 67 is most clearly illustrated in FIGS. 3, 4 and 14, a perspective, end and plan view, respectively. Carrier 67 comprises three parallel beams 68, 110 and 112, whose centers are substantially arranged as the corners of an equilateral triangle. Their lengths are equal except for guide rod 68 which is slidably mounted in upper bushings 64 of frame 50. Beams 110 and 112 are journaled between corresponding corners of triangular plates 117 and 119. Guide rod 68 is affixed to the upper corner of plate 117 and, at a mediate position, to the upper corner of plate 119, rod 68 extending beyond plate 119 and terminating with the pair of opposing rollers 74 and 72 journaled thereon.

Thread guides 70 of group A are affixed to and depend from common cross beam 110. Thread guides 71 of group B are similarly attached to cross beam 112. Cross beam 110 has affixed to it two opposing lever arms: upper arm 113 and lower arm 114 both being part of an integral structure. Journaled on arms 113, 114, are rollers 123 and 124, respectively. Cross beam 112 similarly carries two opposing lever arms 115 and 116 which also terminate in similar, terminal rollers 125 and 126, respectively. Lever arms 113 and 114 are axially displaced relative to lever arms 115 and 116 so that levers 115 and 116 are closer to plate 119 than levers 113 and 114. The rollers attached to the lever arms keeps the frictional component of the steering mechanism rather small.

In the weft thread magazine itself, wedges 140 and 142 are positioned adjacent to transfer chain 22. Similarly, wedges 144 and 146 are positioned adjacent to transfer chain 24. Wedges 140–146 are vertically reciprocatable by linkage driven from pattern wheels, not shown, to move the wedges between effectual and ineffectual positions. The ineffectual positions of all of these wedges is indicated in phantom in FIG. 3. In their effectual positions, wedge 142 can interact with lever arm 114, wedge 140 with lever arm 115, wedge 144 with lever arm 116 and wedge 146 with lever arm 113, in order to move the appropriate thread guide group A or B out of the operative position shown in full in FIG. 3 into the inoperative position as is shown fully drawn out for group B in FIG. 4 and in phantom for group A.

It is thus possible, by means of the double lever arm to steer the thread guide group on both sides in the same manner, the lever arms acting as operating elements.

Referring to FIG. 5, a more detailed view is given of the previously mentioned holding devices. The holding devices 28 are so formed that there is provided a space 130 on the outer side thereof for the holding of a thread portion 134 laid thereabout. There is also provided on holding devices 28 an inner space 132 for the passage therethrough of the inoperative thread portion 136. It is advantageous to provide holding devices 28 with holding means not only on the outside but also on the inside for the uptake of thread material since it is then possible to provide room for the passage of threads which are not displaced in the transverse direction.

The operation will first be described assuming wedges 140–146 are in their ineffectual positions shown in phantom in FIG. 3. Consequently, thread guides 70 and 71 extend vertically downward in the operative positions shown in FIG. 3. Thus the wedges act as a control means (element).

In operation, transfer chains 22 and 24 are driven in a forward or longitudinal direction as shown by arrows 26 and 26' in FIG. 1 and by arrow X1 in FIG. 2. Carriage 44 is moved in the direction of arrow X2 by means of a reciprocating drive arrangement 46 whereby it is made to come to rest for a short period of time at the end of travel of carriage 44, which occurs when rollers 72 and 74 are positioned in the housing 80 where the rearward movement is timed to take place. Carriage 44 is then moved in a longitudinal direction as shown by arrow 96 as the steel band 76 is moved by the steering apparatus coupled to cam 92, via rod 86, as explained earlier. The rearward movement is preferably adjusted to move the thread guides 70 a distance of four holding devices 28 (or a number equal to the number of threads in a group) as determined by the cam surface 94 on cam 92. As the carriage 44 starts to move towards the right, as shown in FIG. 2, a small forward movement of thread guides 70 and 71 occurs in the direction of arrow X3 because of the segment 102 of cam 92. This movement comes to a complete halt as the cam portion 104 comes into contact with contact roller 90. This occurs when the carrier 44 is located inside of the transfer chains 22 and 24.

Thus, when the carriage finds itself outside of the transfer chains 22 and 24 cam segment or portion 106 causes the linkage 86 and 88 to move the thread guide 70 sharply in a rearward direction thereby permitting the thread to move past the holding devices 28 on transfer chains 22 to 24 and the warp around is completed as the carriage then returns towards the opposite transfer chain.

The foregoing will cause the laying of parallel threads from groups A and B together in pairs between chains 22 and 24. All of the threads so laid will be perpendicular to chains 22 and 24.

However, a more complex pattern can be developed as shown in FIG. 2. Therein it will be observed that downstream thread section 69 lies inside and parallel to chain 24 (in space 132 of holder 28 as shown for thread segment 136 in FIG. 5) and was not transferred across to chain 22. This occurred since group A was brought to chain 22 but wedge 142 was in its effectual position causing thread guides 70 to move to the inoperative position illustrated in phantom in FIG. 4. Thread guide 71, being unaffected, remained in the operative position shown in phantom. Consequently, thread group B (but not A) was wrapped about holders 28 of chain 22 to form the perpendicular group B2–B4 shown in FIG. 2, as carriage 44 returned to chain 24.

As the foregoing full group B1–B4 is being laid, all of the wedges 140–146 revert to their ineffectual position so thread guides 70 and 71 are rendered operative and both thread groups A and B are wrapped around holders 28 of chain 24 as illustrated in the thread section immediately upstream from thread section 69. Once this wrap is completed, wedges 140 and 144 move to their effectual positions and wedges 142 and 146 to their ineffectual positions. Consequently, thread guides 70 and 71 will be in the positions illustrated in full in FIG. 4 when carriage 44 intercepts either chain 22 or 24. Therefore as shown for the remaining upstream sections of chains 22 and 24, threads A1–A4 are continually laid and wrapped on holders 28 for each pass between the chains. Accordingly, the threads of group A are laid in space 130 (FIG. 5) of holder 28 as illustrated for thread portion 134. However, since thread guides 71 are in the inoperative position, threads from group B are led to chain 22 and back again without wrapping. The slack that would otherwise be created by this pulling and relaxing is taken up by thread accumulators 81, 82 (FIG. 1). Thread accumulators 81, 82 ensure that the threads are always tensioned between the last holding device 28 to which they are attached and the exit opening of the thread guides 71 and 70.

The result of the foregoing selective rotation of thread guides 70 and 71 in the direction of arrows X4 and X5, respectively, is to reciprocate them between the operative and nonoperative position. It is thus possible to achieve the effect noted in FIG. 2, namely that weft threads A1 through A4 of thread guide group A are laid parallel to each other, whereas the weft threads B1 through B4 may be partially laid together with weft threads A1 through A4 and partially, however, they may be caused to run diagonal to this position.

It will now be assumed that wedges 140–146 are moved according to a predetermined pattern rendering them effectual at various time intervals. The thread guide pattern is illustrated in the diagram of FIG. 6 as producing the lapping pattern of FIG. 7.

Figure 6:
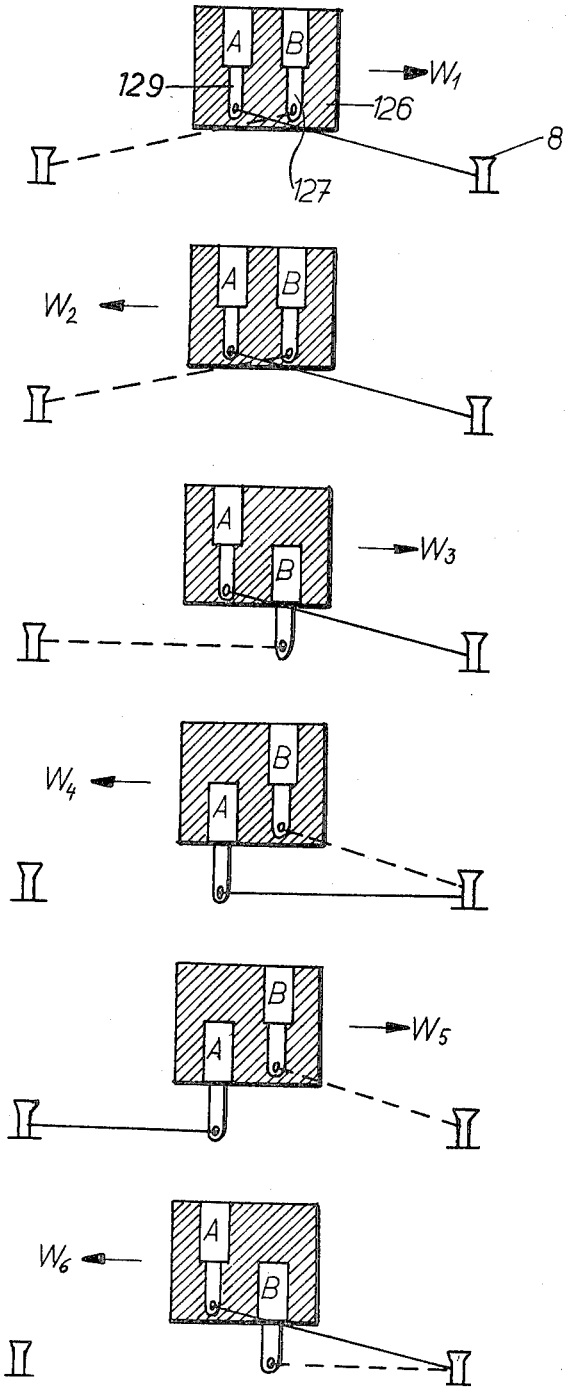
FIG. 6 is a schematic diagram of the operation of two thread guide groups from the apparatus of FIG. 1 in a cycle comprising six different transverse movements.

For the embodiment of FIG. 6, there is provided on one carrier 126 two sets of thread guides 129 and 127 carrying threads of groups A and B, respectively, which may be moved from a lower operative position into an upper inoperative position, in a manner similar to that just described. There is shown a working cycle of six traverse motions W1 through W6 wherein the appropriate arrow indicates the direction of motion. Initially, it is assumed groups A and B were last wrapped on the right chain 22 and left chain 24, respectively. At the end of the traverse motions W1 and W2, both groups A and B are inoperative. At the end of traverse motions W3 and W6, group A is inoperative while group B is operative; and at the end of traverse motions W5 and W4, group B is inoperative and group A is operative. It is only in the operative position that the appropriate weft threads are laid into holding devices 28.

Figure 7:
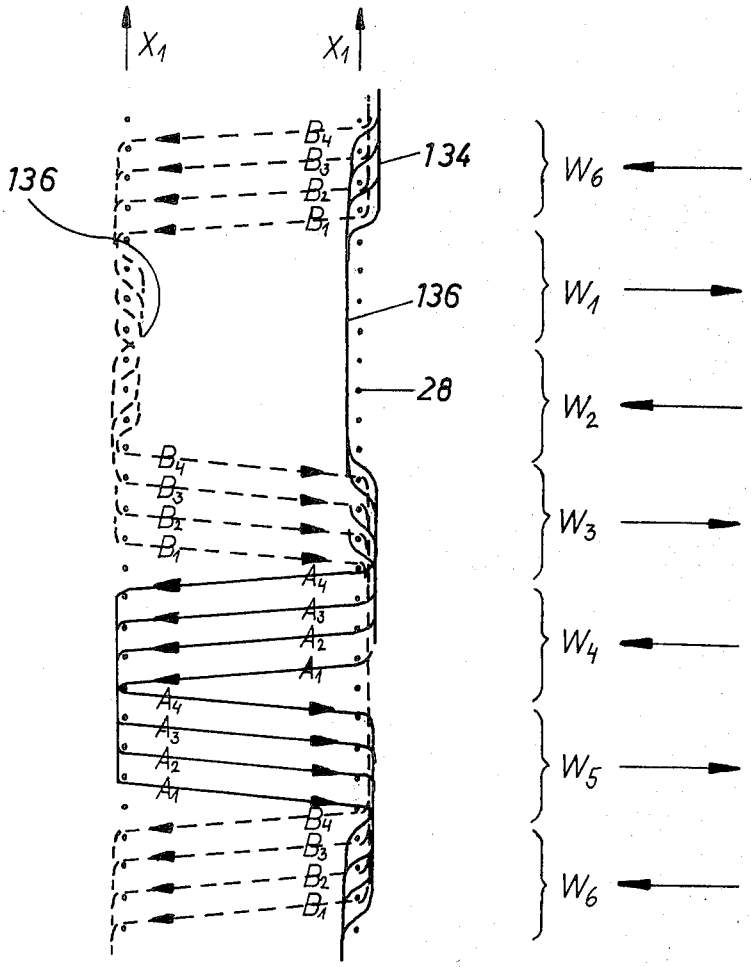
FIG. 7 is a lapping diagram generated from the diagram of FIG. 6.

This leads to the lapping diagram shown in FIG. 7. While in the traverse motion of W1 and W2, no weft threads whatsoever are laid in, during traverse motion W4 and W5, only the weft threads A1 through A4, and during the traverse motions W3 and W6, only the weft threads B1 through B2 are laid in. It should be noted, however, that even during the motion of W1 and W2, the weft threads are carried across to the opposite side. However, during this motion, they are so tensioned during this return by thread accumulators 81 and 82 that they remain in the general domain of that transfer chain around whose holding means they were last laid.

Figure 8:
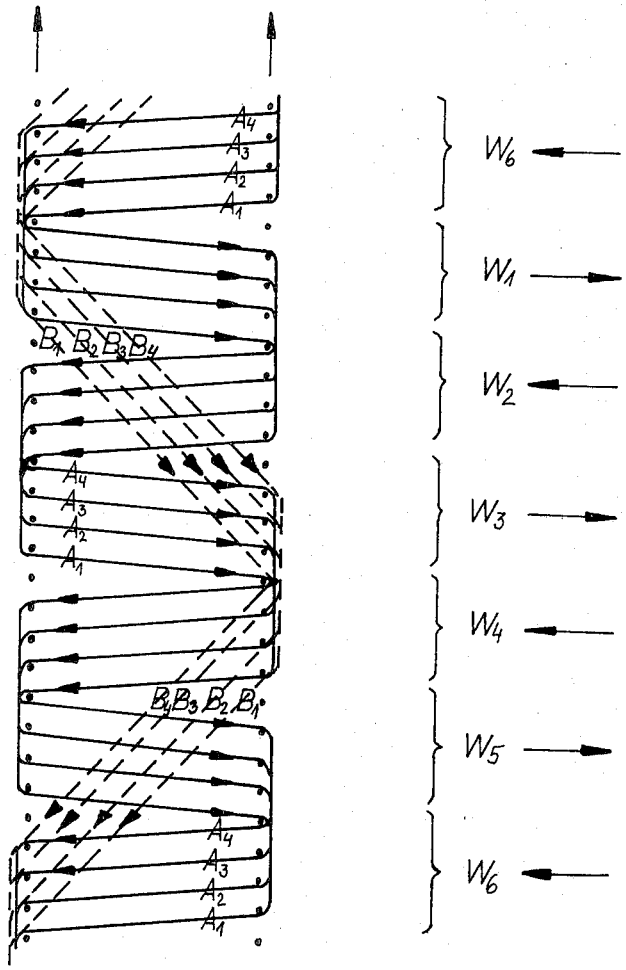
FIG. 8 is another lapping diagram generated from a variation of the diagram of FIG. 6.

FIG. 8 shows a lapping diagram of a different type which occurs when, at the end of traverse movements W1, W2, W4 and W5, only group A is operative, whereas during the traverse movements of W3 and W6, both thread groups A and B are operative. This has the consequence that the constantly operating thread guide group always lays thread groups A1 through A4 in a parallel manner, whereas the thread guide group B lays in the weft threads B1 through B4 in a wide diagonal angle.

Figure 9:
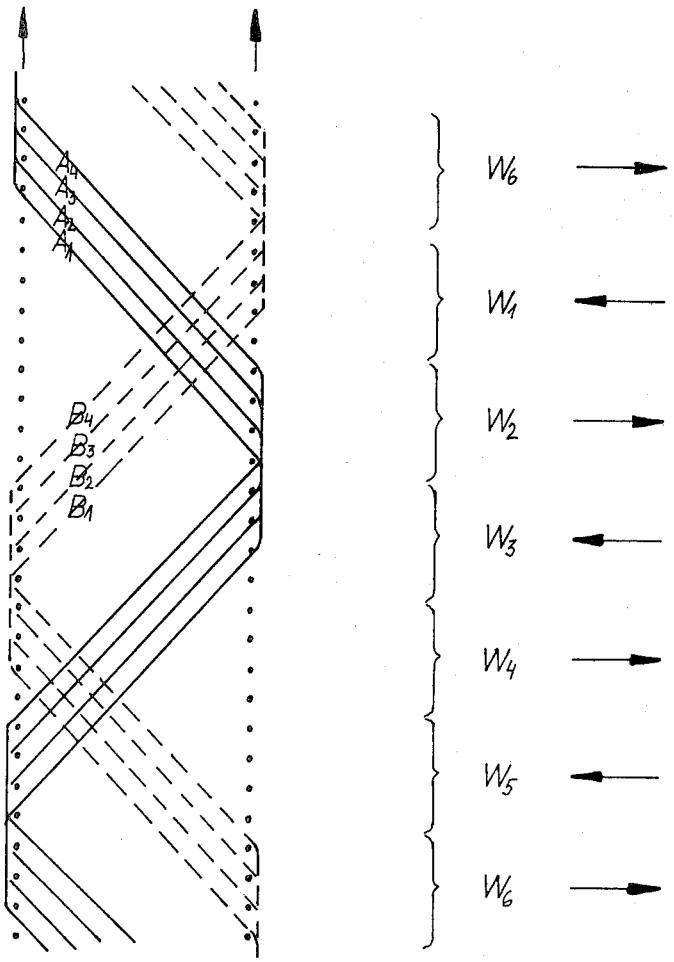
FIG. 9 is yet a further lapping diagram generated from a variation of the diagram of FIG. 6.

In the lapping diagram of FIG. 9, weft threads A1 through A4 and threads B1 through B4 are displaced diagonally with relationship to each other. This occurs when, at the end of traverse movements W2 and W5, group A is operative; and, at the end of traverse movements W3 and W6, group B is operative; and at all other times all groups are inoperative.

Figure 10:
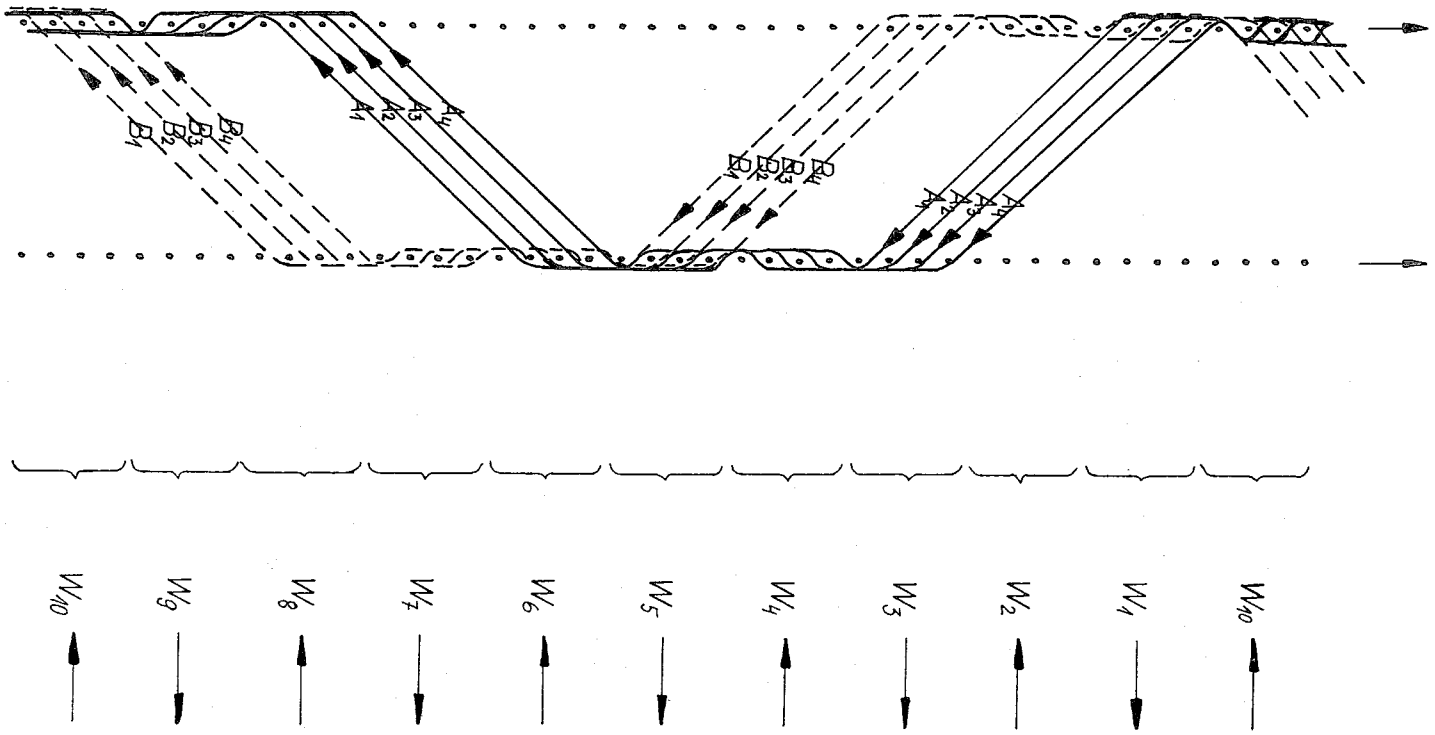
FIG. 10 is a lapping diagram for a cycle having ten transverse movements.

In FIG. 10, there is provided a working cycle of ten cross movements wherein weft threads A1 through A4 and B1 through B4 are displaced diagonally with respect to each other. However, in this embodiment, thread guide group A is made operative at the end of traverse movements W3, W5, W8 and W10; and the thread guide group B is made operative at the end of traverse movements W2, W5, W7 and W10; whereas all of the remaining groups in the remaining traverse movements are inoperative.

Figure 11:
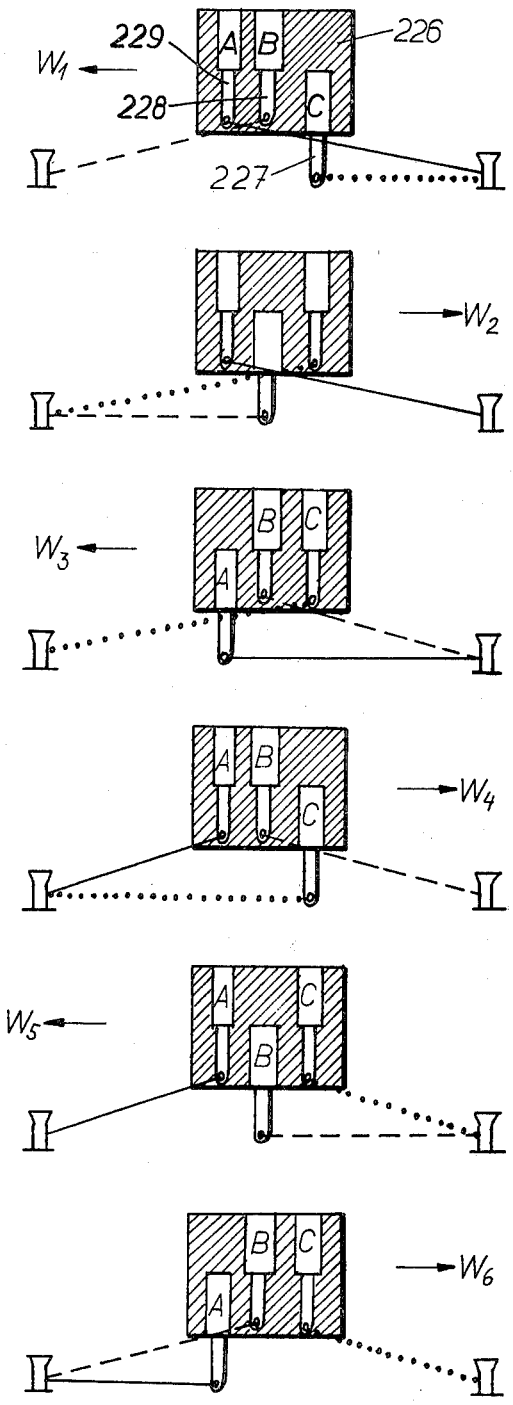
FIG. 11 is a schematic diagram similar to that of FIG. 6 but expanded to three thread guide groups executing transverse movements.
Figure 12:
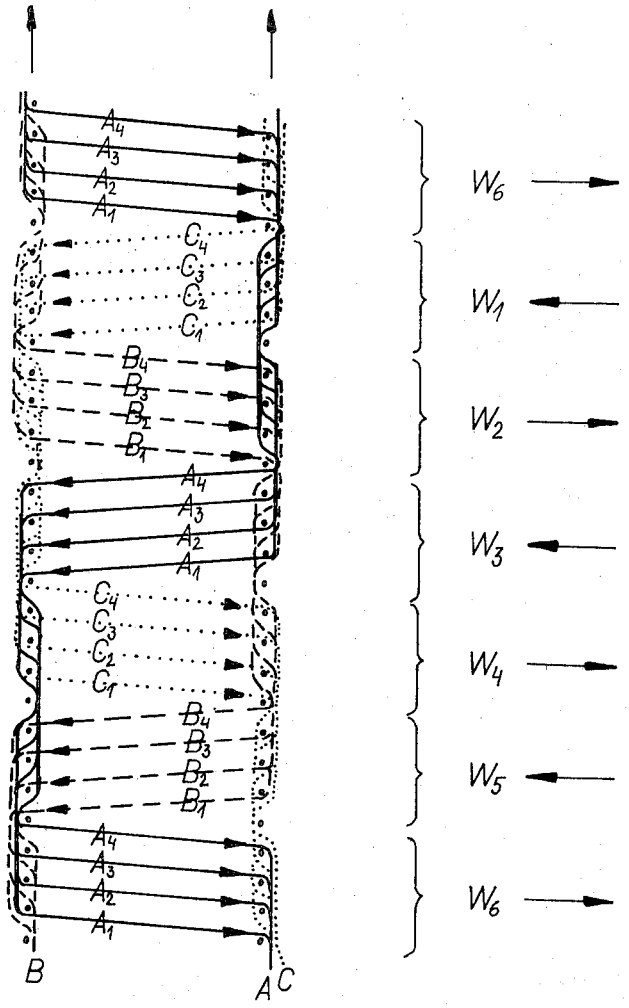
FIG. 12 is a lapping diagram generated from the diagram of FIG. 11.

In the embodiment of FIG. 11, there is provided in carrier 226 three groups A, B and C of thread guides 229, 228 and 227, respectively. In this arrangement, group A is only operative during traverse movements W3 and W6, group B, during traverse movements W2 and W5 and group C during traverse movements W1 and W4. This leads to the lapping diagram of FIG. 12 wherein threads A1 through A4, threads C1 through C4 and threads B1 through B4 follow each other in a repeat pattern.

Figure 13:
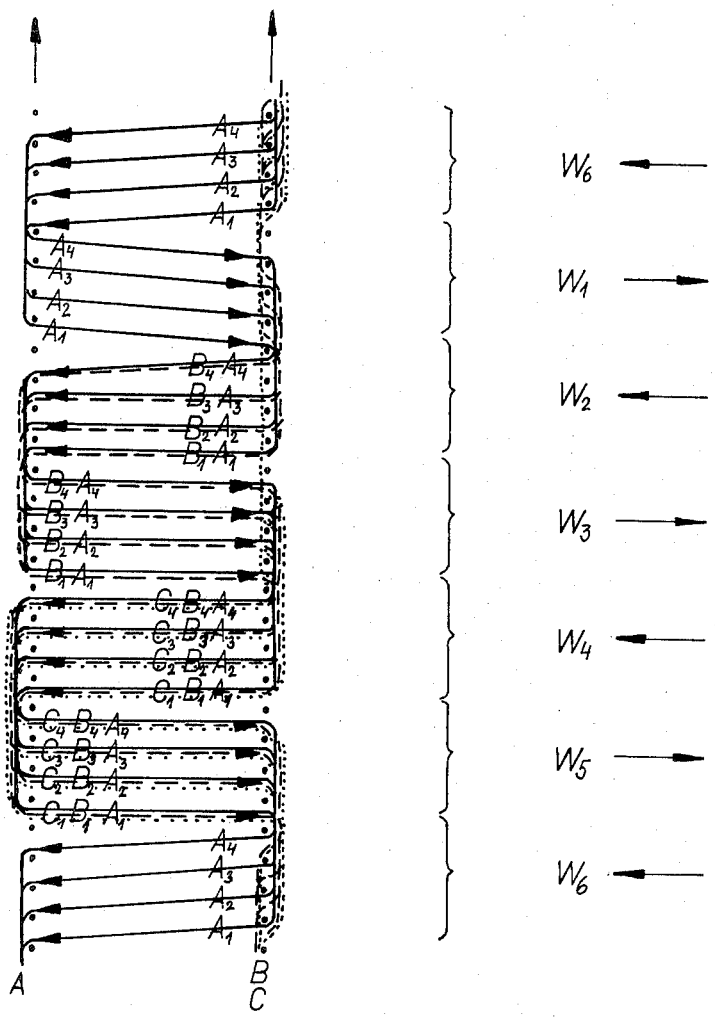
FIG. 13 is another lapping diagram generated from a variation of the diagram of FIG. 11.

In the arrangement of the lapping diagram showing in FIG. 13, during traverse movements W1 and W6, only weft threads A1 through A4 are displaced, whereas during traverse movements W2 and W3, weft threads A1 through A4 and B1 through B4 are displaced, and during traverse movements W4 and W5, the weft threads of all three groups A, B and C are displaced at the same time. This is achieved in that the thread guide group A is continually operative, thread guide group B is inoperative at the end of cross movement W6, and thread guide group C is inoperative at the end of cross movements W2 and W6.

It will thus be seen that a vast number of weft thread possibilities may be achieved. The weft threads can be laid parallel after each other (see W3 through W6 in FIG. 7 and FIG. 12), they can be laid diagonally after each other (FIG. 10), they can be laid at the same time parallel and on top of each other (FIG. 13), they can at the same time be laid over each other in a diagonal manner (FIG. 8 and FIG. 9), the weft thread laying can be suppressed (W1 through W2 in FIG. 7), the diagonals can be provided with a different angle. The different possibilities can be combined and much, much more. Through drawing in the thread inside a particular thread guide group, the pattern possibilities can again be considerably increased.

In the working example, it is shown that the thread guides 70 and 71 provide the weft threads directly to holding devices 28. The same effect may, however, be achieved with those known weft thread magazines in which the thread guides lay the weft threads into intermediate holders which then transfer the weft threads to the holders of the transfer chain.

Hereinbefore has been disclosed a simple and effective apparatus for providing a repeating pattern with inlaid weft threads. Using the foregoing teachings, it is easily possible to make certain material with a weft repeat of 120. There are many possible methods of bringing the thread guide groups from the operative into the inoperative position. It is particularly simple to do this either by lifting, or turning the guides about a longitudinal axis. It is particular advantageous to use a control arrangement wherein the thread guide groups are directly and mechanically connected to operating elements which interact with control elements that are selectively brought into the path of the operating elements and by interaction with the operating elements cause the displacement of the thread guide groups. Since the control elements are located in one position they are comparatively easy to activate, for example, by means of a pattern chain or a jacquard arrangement.

In this connection, it is advantageous (but not necessary) if the thread guide group normally is found in the operative position and the steering element is placed close to the thread transfer chains. It is sufficient merely to bring the thread guide groups into the inoperative position in the vicinity of the transfer chain in order to prevent the interaction of the weft threads with the holding devices. However, deflection of the guides can occur over a longer interval and need not, as in the preferred embodiment, deflect only at the transfer chains. While the preferred embodiment employs an operating element comprising a lever arm which is directly connected to a cross beam carrying the thread guide groups, in some embodiments, alternate operating elements including electromechanical, pneumatic or other devices are possible. Also, while the control element comprised a wedge which may be brought into the path of the lever arm, other shapes for the control element are contemplated. Furthermore, while the cross movement of the carriage itself brings about the engagement of the wedge and the lever arm, a separate motive source may be used in other embodiments.

While it is desirable to provide two lever arms in opposite directions (and that two wedges are provided therefore) in some embodiments, a single lever arm will be sufficient. Also the wedges in the vicinity of the transfer chains may be brought into the path of the lever arms in different directions. It will therefore be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. A weft thread magazine for a warp knitting machine having a needle bed, said magazine comprising:

(a) a pair of endless transfer means, each having holding means for retaining weft threads in parallel and for delivering them to said needle bed;

(b) a thread laying arrangement operable to transversely reciprocate between said pair of transfer means and to transport weft threads from one of said pair of transfer means to the other, said arrangement including carriage means having a plurality of thread guides for transferring weft threads around said holding means as said thread laying arrangement reverses direction, said thread guides being reciprocatable between an operative and inoperative position, in said inoperative position, said thread guides being precluded from transferring thread to said holding means; and (c) control means for moving said thread guides between said operative and inoperative position.

2. A weft thread magazine according to claim 1 wherein said plurality of thread guides are divisible into at least two groups, said control means being operable to separately move each of said groups between said operative and inoperative position.

3. A weft thread magazine according to claim 1 wherein said thread guides of said magazine are adapted to receive a plurality of weft threads, said magazine further comprising:

a thread accumulator coupled onto the thread path of said plurality of weft threads upstream from said thread guides for tensioning the weft threads.

4. A weft thread magazine according to claim 2 wherein said groups of thread guides in moving from the operative to inoperative position are raised.

5. A weft thread magazine according to claim 4 wherein said thread guides are mounted in said arrangement to rotate about a longitudinal axis when moving between the operative and inoperative position.

6. A weft thread magazine according to claim 2 wherein said control means comprises:

(a) an operating element connected to said thread guides, motion of said operating element causing at least one of the groups of said thread guides to move; and (b) a control element moveable into a positionally fixed position to engage said operating element as it moves and to displace at least one of said thread guides.

7. A weft thread magazine according to claim 5 wherein said control means comprises:

(a) a pair of steering elements each located adjacent to a different corresponding one of said pair of transfer means, said thread guides normally being in said operative position before engaging said steering elements.

8. A weft thread magazine according to claim 6 wherein said operating element comprises:

(a) a beam upon which at least one of said thread guides are mounted; and (b) a lever arm affixed to said beam.

9. A weft thread magazine according to claim 8 wherein said control element comprises:

a wedge moveable into the path of said lever arm for engaging it.

10. A weft thread magazine according to claim 6 wherein said operating element comprises:

(a) a beam upon which at least one of said thread guides is mounted; and (b) a pair of opposite lever arms extending from said beam said control element including:

a pair of wedges each positioned adjacent to a different corresponding one of said pair of transfer means, each wedge being moveable into the path of a different corresponding one of said pair of lever arms.

11. A weft thread magazine according to claim 10 wherein each of said lever arms terminate in a roller.

12. A weft thread magazine according to claim 11 wherein said holding means has a space on its inside and outside for the passage of thread.

* * * * *